US011877593B2

(12) United States Patent
Nappi

(10) Patent No.: US 11,877,593 B2
(45) Date of Patent: Jan. 23, 2024

(54) AEROSOL GENERATING ARTICLE HAVING IMPROVED MOUTH END CAVITY

(71) Applicant: PHILIP MORRIS PRODUCTS S.A., Neuchatel (CH)

(72) Inventor: Leonardo Nappi, Neuchatel (CH)

(73) Assignee: Philip Morris Products S.A., Neuchatel (CH)

( * ) Notice: Subject to any disclaimer, the term of this patent is extended or adjusted under 35 U.S.C. 154(b) by 119 days.

(21) Appl. No.: 16/766,111

(22) PCT Filed: Nov. 28, 2018

(86) PCT No.: PCT/EP2018/082885
§ 371 (c)(1),
(2) Date: May 21, 2020

(87) PCT Pub. No.: WO2019/106038
PCT Pub. Date: Jun. 6, 2019

(65) Prior Publication Data

US 2020/0352218 A1 Nov. 12, 2020

(30) Foreign Application Priority Data

Nov. 28, 2017 (EP) ..... 17204219

(51) Int. Cl.
*A24D 3/02* (2006.01)
*A24D 1/00* (2020.01)
(Continued)

(52) U.S. Cl.
CPC ..... *A24D 3/0291* (2013.01); *A24D 1/004* (2013.01); *A24D 1/042* (2013.01); *A24D 3/04* (2013.01); *A24D 3/18* (2013.01)

(58) Field of Classification Search
CPC ..... A24D 1/004; A24D 1/042; A24D 1/20; A24D 3/0291; A24D 3/04; A24D 3/18
See application file for complete search history.

(56) References Cited

U.S. PATENT DOCUMENTS 3,095,343 A 6/1963 Berger
3,533,416 A 10/1970 Berger
(Continued)

FOREIGN PATENT DOCUMENTS

DE 3246898 7/1983
EP 0364253 4/1990
(Continued)

OTHER PUBLICATIONS

"Denier Measurements: Definition of Clothing Apparel Search." Denier Measurements for Fibers and Fabric Provided by Apparel Search, https://www.apparelsearch.com/definitions/miscellaneous/denier_measurement_definition.htm. (Year: 2018).*
(Continued)

*Primary Examiner* — Kelly M Gambetta
*Assistant Examiner* — Stephanie Lynn Moore
(74) *Attorney, Agent, or Firm* — Mueting Raasch Group

(57) ABSTRACT

An aerosol-generating article (10) comprising: an aerosol generating substrate (12); and a mouthpiece (14) disposed downstream of the aerosol-generating substrate (12). The mouthpiece (14) comprises a hollow tubular segment (24) at its downstream end defining a mouth end cavity (40). The hollow tubular segment (24) comprises a hollow tube (31) of crimped fibrous material, and a plurality of non-crimped fibers (35) extending along and affixed to the inner surface (311) of the hollow tube (31).

15 Claims, 2 Drawing Sheets

(51) Int. Cl.

| | |
|---|---|
| ***A24D 1/04*** | (2006.01) |
| ***A24D 3/18*** | (2006.01) |
| ***A24D 3/04*** | (2006.01) |

(56) References Cited

U.S. PATENT DOCUMENTS

| | | | | |
|---|---|---|---|---|
| 3,703,429 | A | 11/1972 | Berger | |
| 4,022,221 | A | 5/1977 | Berger | |
| 4,022,222 | A * | 5/1977 | Berger | A24D 3/0283 131/338 |
| 5,076,292 | A | 12/1991 | Sensabaugh, Jr. | |
| 2010/0288293 | A1* | 11/2010 | Slash | A24D 3/041 131/338 |
| 2010/0300468 | A1* | 12/2010 | Rustemeyer | A24D 3/0204 131/331 |
| 2013/0255704 | A1* | 10/2013 | Sampson | A24D 3/048 131/345 |
| 2015/0164133 | A1* | 6/2015 | Davis | A24D 3/0212 493/39 |
| 2017/0055581 | A1* | 3/2017 | Wilke | A24F 40/465 |

FOREIGN PATENT DOCUMENTS

| | | |
|---|---|---|
| EP | 2583570 | 2/2015 |
| EP | 2893820 | 7/2015 |
| EP | 3000335 | 3/2016 |
| GB | 2113066 | 8/1983 |
| JP | S58-155073 | 9/1983 |
| JP | 2010-533482 | 1/2009 |
| WO | WO 2005/084466 | 9/2005 |
| WO | WO 2006/048774 | 5/2006 |
| WO | WO 2009/010380 | 1/2009 |
| WO | WO 2010/010397 | 1/2010 |
| WO | WO 2011/058319 | 5/2011 |
| WO | WO 2012/138630 | 10/2012 |
| WO | WO 2013/000967 | 1/2013 |
| WO | WO 2014/023555 | 2/2014 |
| WO | WO 2014/023557 | 2/2014 |
| WO | WO 2014/064087 | 5/2014 |
| WO | WO 2014/096291 | 6/2014 |
| WO | WO 2017/198995 | 11/2017 |

OTHER PUBLICATIONS

PCT Search Report and Written Opinion for PCT/EP2018/082885 dated Mar. 1, 2019 (9 pages).

U.S. Appl. No. 10/334,875, filed Jul. 2, 2019, Sampson.

Office Action issued in Japan for Application No. 2020-522810 dated Nov. 2, 2022 (3 pages).

* cited by examiner

AEROSOL GENERATING ARTICLE HAVING IMPROVED MOUTH END CAVITY

This application is a U.S. National Stage Application of International Application No. PCT/EP2018/082885 filed Nov. 28, 2018, which was published in English on Jun. 6, 2019 as International Publication No. WO 2019/106038 A1. International Application No. PCT/EP2018/082885 claims priority to European Application No. 17204219.4 filed Nov. 28, 2017.

The invention relates to aerosol-generating articles having a mouth end cavity. The invention is particularly applicable to filter cigarettes having a mouth end cavity.

Filter cigarettes are one example of aerosol-generating articles. Filter cigarettes typically comprise a rod of tobacco cut filler surrounded by a paper wrapper and a cylindrical filter aligned in end-to-end relationship with the wrapped tobacco rod, with the filter attached to the tobacco rod by tipping paper. In conventional filter cigarettes, the filter may consist of a plug of cellulose acetate tow wrapped in porous plug wrap. Filter cigarettes with multi-component filters that comprise two or more segments of filtration material for the removal of particulate and gaseous components of the mainstream smoke are also known. Aerosol-generating articles having a cavity at their mouth end have also been proposed.

A number of aerosol-generating articles in which an aerosol forming substrate, such as tobacco, is heated rather than combusted have also been proposed in the art. In heated aerosol-generating articles, the aerosol is generated by heating the aerosol forming substrate. Known heated aerosol-generating articles include, for example, aerosol-generating articles in which an aerosol is generated by electrical heating or by the transfer of heat from a combustible fuel element or heat source to an aerosol forming substrate. During use, volatile compounds are released from the aerosol forming substrate by heat transfer from the heat source and entrained in air drawn through the aerosol-generating article. As the released compounds cool, they condense to form an aerosol that is inhaled by the consumer. Also known are aerosol-generating articles in which a nicotine-containing aerosol is generated from a tobacco material, tobacco extract, or other nicotine source, without combustion, and in some cases without heating, for example through a chemical reaction.

As noted above, in some cases, an aerosol-generating article may have a cavity at its mouth end. Such mouth end cavities are typically formed by extending the plug wrap, the tipping paper, or both the plug wrap and the tipping paper of the filter beyond the most downstream filter segment. The mouth end cavity may be alternatively or additionally formed by a hollow tubular segment at the mouth end of the aerosol-generating article.

A number of solutions have been proposed for providing the inner surface of the mouth end cavity with a distinctive appearance, such as a distinctive colour or indicia. For example, EP 2 583 570 B1 describes a filter cigarette having a mouth end cavity formed by extending the plug wrap and the tipping paper of the filter beyond the most downstream filter segment, and printing an indicia on the inner surface of the plug wrap. However, this solution may not always be effective. For example, this solution may not be effective when the mouth end cavity is formed by a discrete hollow tubular segment, such as a hollow tube of fibrous material, because it is not possible to easily print onto such fibrous material.

It would therefore be desirable to provide an aerosol-generating article having a mouth end cavity with a distinctive appearance, such as a distinctive colour or indicia. It would be further desirable to provide an aerosol-generating article having a mouth end cavity with a distinctive appearance, where the mouth end cavity is formed by a discrete hollow tubular segment, such as a hollow tube of fibrous material.

According to a first aspect of the present invention, there is provided an aerosol-generating article comprising: an aerosol-generating substrate and a mouthpiece disposed downstream of the aerosol-generating substrate. The mouthpiece comprises: a hollow tubular segment at its downstream end defining a mouth end cavity. The hollow tubular segment comprises: a hollow tube of crimped fibrous material; and a plurality of non-crimped fibers extending along and affixed to the inner surface of the hollow tube.

According to a second aspect of the present invention, there is provided a hollow tubular segment for a mouthpiece of an aerosol-generating article, the hollow tubular segment comprising: a hollow tube of crimped fibrous material, and a plurality of non-crimped fibers extending along and affixed to the inner surface of the hollow tube.

By forming the hollow tubular segment from a hollow tube of crimped fibrous material; and a plurality of non-crimped fibers extending along and affixed to the inner surface of the hollow tube, the inner surface of the hollow tubular segment can have a distinctive appearance over the cavities of prior art articles. In particular, the inner surface can have a distinctive appearance over cavities that are solely defined by a hollow tube of crimped fibrous material. This is because the plurality of non-crimped fibers are able to provide a shiny appearance to the mouth end cavity, which would not be achievable by conventional crimped fibers. In particular, the present inventor has recognised that once a fibre has been crimped the fibre generally loses any shiny appearance that the fibre had. As a result, hollow tubes formed of such crimped fibers do not tend to have any degree of shiny appearance on their inner surface.

In contrast, by forming the hollow tubular segment of the invention with a plurality of non-crimped fibers extending along and affixed to the inner surface of the hollow tube, a shiny appearance can be provided to the inner surface of the hollow tubular segment. Furthermore, by forming the hollow tubular segment from a hollow tube of crimped fibrous material, the hollow tubular segment can still possess desirable structural and functional properties.

As used herein, the terms "upstream" and "downstream" are used to describe the relative positions of features of the aerosol-generating article according to the invention in relation to the direction of aerosol drawn from the aerosol generating substrate through the mouthpiece during use. For example, in a mouthpiece where a cavity is upstream of a mouth end segment, aerosol is drawn first through the cavity and then through the mouth end segment.

The term "inner surface" is used throughout the specification to refer to the surface of a component of the aerosol-generating article that is facing towards the interior of the aerosol-generating article. On the other hand, the term "outer surface" is used throughout the specification to refer to the surface of a component of the article that is facing towards the exterior of the article. For example, a wrapper circumscribing a mouthpiece segment comprises an outer surface that is facing the exterior of the aerosol-generating article and an inner surface that is facing towards the mouthpiece segment.

Each of the non-crimped fibers may have a base colour that is different from the colour of crimped fibers forming the hollow tube of crimped fibrous material. The base colour may be provided by including a dye in the non-crimped fibers, or may be inherent in the material of the non-crimped fibers. For example, if the crimped fibers of the hollow tube appear substantially or wholly white, then the non-crimped fibers may be provided with a base colour, which is substantially or wholly non-white. This can help to further improve the distinctive appearance provided by the non-crimped fibres at the mouth end cavity.

An indicia may be printed onto the inner surface of the hollow tubular segment formed by the plurality of non-crimped fibers. Alternatively or in addition, an indicia may be formed on the inner surface of the hollow tubular segment by providing different base colours to different fibers in the plurality of non-crimped fibers. For example, a section of the plurality of non-crimped fibers may be provided with a red base colour, whereas one or more other sections of the plurality of non-crimped fibers may be provided with one or more other colours, such as blue or green. The respective sections of the plurality of non-crimped fibers can then be arranged on the inner surface of the hollow tube to provide an indicia.

The term "indicia" is used to refer to a discrete printed element, or repeating printed elements or patterns that provides an aesthetically pleasing representation. The indicia may be in the form of text, images, letters, words, logos, patterns or a combination thereof. For example, the indicia on the inner surface of the mouth end cavity according to the present invention may comprise a brand or manufacturer logo that allows the consumer to identify the type or origin of the aerosol-generating article. Alternatively, the indicia may comprise a repeating printed element or pattern on the inner surface of the wrapper material. The indicia may be generally aligned with the axis of the aerosol-generating article, generally perpendicular with the axis of the aerosol-generating article, or at an angle other than parallel or perpendicular with the aerosol-generating article. In addition, different indicia could be provided on a number of aerosol-generating articles that are sold together. For example, in one package the aerosol-generating articles may include two or more different types of indicia. In addition, the indicia could be presented in a way that presents a message, for example with the indicia on adjacent aerosol-generating articles in a package visible when the packaging is opened and the visible indicia spelling a word or otherwise collectively conveying a message.

The non-crimped fibers may have a denier per filament of about 6 or more. The non-crimped fibers may have a denier per filament of about 7 or more. The non-crimped fibers may have a denier per filament of about 12 or less. In some embodiments, the non-crimped fibers have a denier per filament of from about 6 to about 12. In some embodiments, the non-crimped fibers have a denier per filament of from about 6 to about 10. In some embodiments, the non-crimped fibers have a denier per filament of from about 7 to about 9. In some embodiments, the non-crimped fibers have a denier per filament of about 8. Such relatively high denier per filament values for the non-crimped fibers can help to improve the machinability of the fibers. Such relatively high denier per filament values for the non-crimped fibers can help to improve the strength of the fibers. This may help to improve one or more of the ease and reliability of manufacturing a hollow tubular segment with such non-crimped fibers on the inner surface.

The non-crimped fibers may have a total denier of about 6,000 or more. The non-crimped fibers may have a total denier of about 10.000 or more. The non-crimped fibers may have a total denier of about 20,000 or less. In some embodiments, the non-crimped fibers have a total denier of from about 6,000 to about 20,000. In some embodiments, the non-crimped fibers have a total denier of from about 8,000 to about 15,000. In some embodiments, the non-crimped fibers have a total denier of from about 10,000 to about 12,000. In some embodiments, the non-crimped fibers have a total denier of about 11,000.

The non-crimped fibers may cover the entire inner surface of the hollow tube of crimped fibrous material. That is, preferably, the non-crimped fibers form a substantially continuous layer covering the inner surface of the hollow tube of crimped fibrous material. The substantially continuous layer preferably covers the entire inner surface of the hollow tube of crimped fibrous material. This can help to ensure that at least a portion of the non-crimped fibers are always visible at the mouth end of the aerosol-generating article, regardless of the orientation of the hollow tubular segment in the aerosol-generating article. This may also be easier from a manufacturing perspective.

The non-crimped fibers may alternatively cover only a portion of the inner surface of the hollow tube of crimped fibrous material. In such embodiments, the portion of the inner surface covered by the non-crimped fibers is preferably at the downstream end of the hollow tubular segment. This can help to ensure that at least a portion of the non-crimped fibers are visible at the mouth end of the aerosol-generating article.

Where the non-crimped fibers form a substantially continuous layer, the substantially continuous layer preferably has a thickness of from about 300 microns to about 500 microns. The substantially continuous layer may have a thickness of 300 microns or more. The substantially continuous layer may have a thickness of 500 microns or less. Using such a thickness for the substantially continuous layer can help to reduce the risk of portions of the hollow tube of crimped fibres being visible through the layer.

The non-crimped fibers may comprise Polylactic acid (PLA) or an acetate ester of cellulose. The acetate ester of cellulose may be selected from the group of cellulose acetate, cellulose diacetate and cellulose triacetate. The acetate ester of cellulose may be cellulose diacetate. Such fibers can provide a particularly shiny appearance when they are in a non-crimped state.

A binder may be disposed between the plurality of non-crimped fibers and the inner surface of the hollow tube. The binder may be an ester of glycerol. The ester of glycerol may be triacetin (also known as glycerol triacetate). The ester of glycerol may be triethyl citrate, as an alternative or in addition to triacetin.

The binder may be suitable for binding the crimped fibers of the hollow tube together and for binding the plurality of non-crimped fibers to the inner surface of the hollow tube. This may help to improve the attachment between the plurality of non-crimped fibers and the hollow tube. The use of such a binder is particularly beneficial when the crimped fibers of the hollow tube comprises fibers formed of a first type of polymer, and the plurality of non-crimped fibers comprises at least 20 percent by weight of the first type of polymer. This is because the binder can interact with the first type of polymer in the fibers and polymeric film to secure fibers at the inner surface of the hollow tube to the polymeric film. This is particularly advantageous when the binder is a solvent for the fibers of the first type of polymer. The crimped and the non-crimped fibers may consist solely of the first type of polymer. The first type of polymer may be an acetate ester of cellulose. The first type of polymer may be Polylactic acid (PLA).

The combination of a first type of polymer in the form of an acetate ester of cellulose and a binder in the form of an ester of glycerol can be particularly advantageous. This is because, unlike conventional adhesives, the ester of glycerol interacts with the acetate ester of cellulose in the crimped fibers of the hollow tube and the plurality of non-crimped fibers, to bond or otherwise weld the plurality of non-crimped fibers to the crimped fibers on the inner surface of the hollow tube. For example, the acetyl groups of the ester of glycerol can interact with the acetate ester of cellulose through dipolar interactions and hydrogen bonding. This can form a secure attachment between the plurality of non-crimped fibers and the inner surface of the hollow tube, and leave the inner surface of the hollow tubular segment with a desirable appearance. Furthermore, because binders in the form of an ester of glycerol are often used when manufacturing hollow tube of fibrous material to act as a plasticiser for the tube, the plurality of non-crimped fibers can be advantageously secured to the hollow tube during the process of manufacturing the hollow tube. This may allow for the hollow tubular segment of the present invention to be manufactured on existing machinery using existing processes and techniques, with little or no modification.

The hollow tubular segment may comprise an adhesive for securing the plurality of non-crimped fibers to the inner surface of the hollow tube. The adhesive may be polyvinyl alcohol (PVA) or a hot melt adhesive. The adhesive may comprise polypropylene. The adhesive may comprise ethylene-vinyl acetate or ethylene-ethyl acrylate. The adhesive may comprise polyethylene.

The number of non-crimped fibers affixed to the inner surface of the hollow tube may be about 400 or more, more preferably about 600 or more. The number of non-crimped fibers affixed to the inner surface of the hollow tube may be about 1000 or less, more preferably about 800 or less. The number of non-crimped fibers affixed to the inner surface of the hollow tube may be between about 600 and about 800.

Each of the plurality of non-crimped fibers may extend substantially in the longitudinal direction of the aerosol-generating article. This may provide a particularly desirable appearance at the mouth end cavity. This may also help to ease the manufacture of the hollow tubular segment.

The aerosol-generating article of the present invention comprises an aerosol-forming substrate. As used herein, the term 'aerosol-forming substrate' relates to a substrate capable of releasing volatile compounds that can form an aerosol. Such volatile compounds may be released by heating the aerosol-forming substrate. An aerosol-forming substrate may be adsorbed, coated, impregnated or otherwise loaded onto a carrier or support. An aerosol-forming substrate may conveniently be part of an aerosol-generating article or smoking article.

The aerosol-generating article of the present invention may be configured for use with an aerosol-generating device. As used herein, an 'aerosol-generating device' relates to a device that interacts with an aerosol-forming substrate to generate an aerosol. The aerosol-generating article of the present invention may itself comprise a heat source and at least one heat-conducting element for transferring heat from the heat source to the aerosol-forming substrate of the article.

The aerosol-generating article of the present invention may be a smoking article, such as a filter cigarette or other smoking article, in which an aerosol-generating substrate comprises a tobacco material that is combusted to form smoke. Therefore, in any of the embodiments described above, the aerosol-generating substrate may comprise a tobacco rod. Furthermore, in any of the embodiments described above, the mouthpiece may be a filter. In such embodiments, the filter may be secured to the tobacco rod by a tipping paper.

The mouthpiece may comprise one or more segments disposed upstream of the hollow tubular segment. The hollow tubular segment may be directly adjacent to the aerosol-forming substrate. The fibrous material of the hollow tube may comprise cellulose based fibers, such as cellulose acetate fibers.

The mouthpiece may be secured to at least a downstream portion of the aerosol forming substrate. For example, a wrapper such as a tipping wrapper may circumscribes the mouthpiece and at least a downstream end portion of the aerosol forming substrate to join the mouthpiece and aerosol-forming substrate together.

The hollow tubular segment may have a substantially annular cross section. That is hollow tube segment may be formed from a hollow tube that is an annular shaped segment of filtration material, such as cellulose acetate. The annular shaped hollow tube has a hollow core extending from the upstream end of the annular shaped segment to the downstream end of the annular shaped segment. Such segments may be referred to as a hollow acetate tube. The hollow core may have a substantially constant cross-sectional area for the aerosol to flow through. This provides a substantially cylindrical surface for the plurality of non-crimped fibers to be secured to.

According to a second aspect of the invention, there is provided a method of forming a hollow tubular segment for a mouthpiece of an aerosol-generating article. The method comprises: conveying a first continuous band of crimped fibers; conveying a second continuous band of non-crimped fibers; shaping a portion of the first continuous band into a substantially annular shape having an outer surface and an inner surface; conveying the second continuous band into contact with the inner surface of the substantially annular shaped portion of the first continuous band; and affixing the contacted portions together and cutting a segment of the affixed portions from the continuous band to form a hollow tubular segment for a mouthpiece of an aerosol-generating article.

The method may further comprise spraying a binder onto the annular shaped portion such that at least some binder resides on the inner surface of the annular shaped portion, prior to affixing the contacted portions together.

The method of the third aspect of the invention may advantageously allow for the hollow tubular segment of the first and second aspect of the invention to be manufactured on existing machinery using existing processes and techniques, with little or no modification.

It will be appreciated that preferred features described above in relation to one aspect of the invention may also be applicable to other aspects of the invention.

Embodiments of the invention will now be described, by way of example only, with reference to the accompanying drawings, in which.

Figure 1:
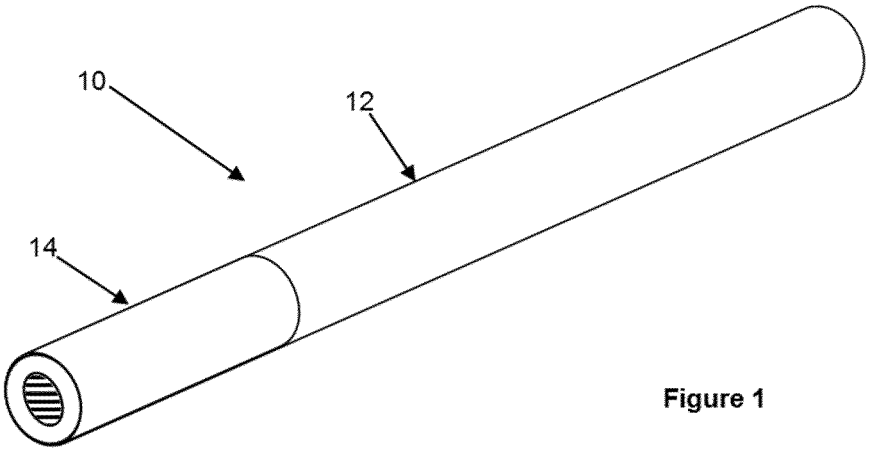
FIG. 1 shows an aerosol-generating article in accordance with a first embodiment of the present invention.
Figure 2:
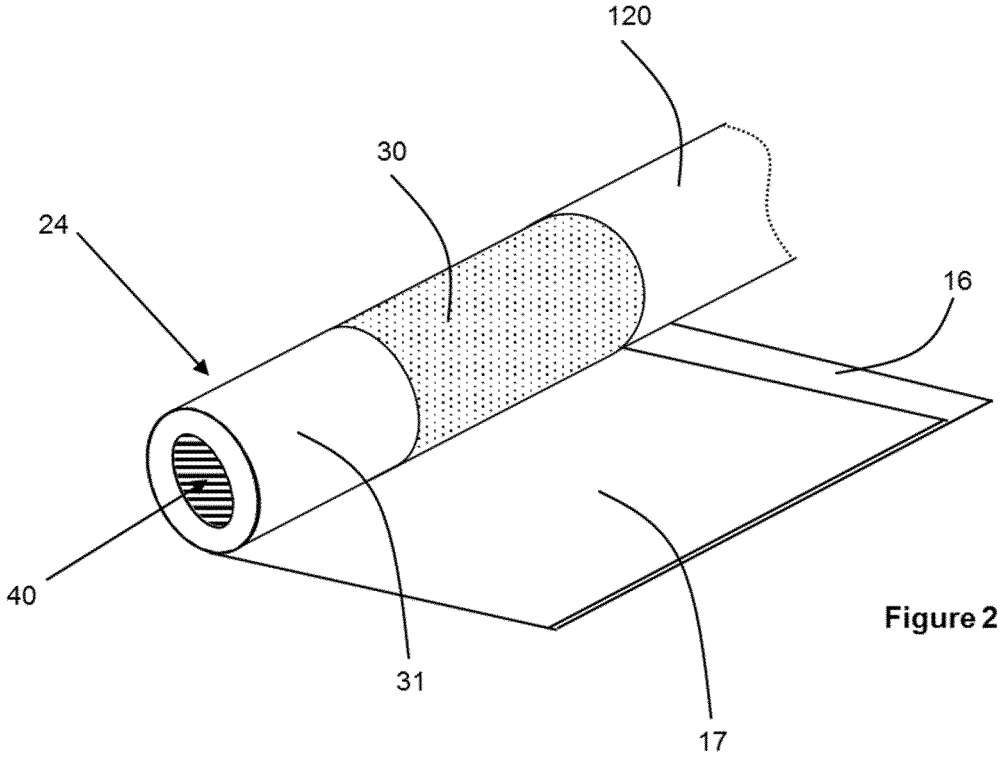
FIG. 2 shows a view of the aerosol-generating article of FIG. 1 with the mouthpiece unwrapped.

FIGS. 1 and 2 illustrate an aerosol-generating article 10 in accordance with a first embodiment the present invention. The article is in the form of a smoking article. The smoking article 10 comprises an aerosol forming substrate in the form of wrapped rod 12 of tobacco cut filler. The rod 12 is attached at one end to a mouthpiece, in the form of axially aligned filter 14. A band of tipping paper 16 circumscribes the filter 14 and a portion 120 of the wrapped rod 12 of tobacco to join together the two portions of the smoking article 10.

As shown in FIG. 2, the filter 14 comprises a hollow tubular segment 24. The hollow tubular segment 24 comprises a hollow tube 31 of crimped fibrous material, in the form of cellulose acetate tow. The hollow tubular segment 24 is at the downstream end of the filter 14, and defines a mouth end cavity 40 of the article 10. Upstream of the hollow tubular segment 24 is a filter segment 30, also formed of fibrous material, such as cellulose acetate tow. The filter segment 30 is adjacent to the hollow tubular segment 24. The filter segment 30 and hollow tubular segment 24 are secured to one another by a circumscribing combining plug wrap 17.

Figure 3:
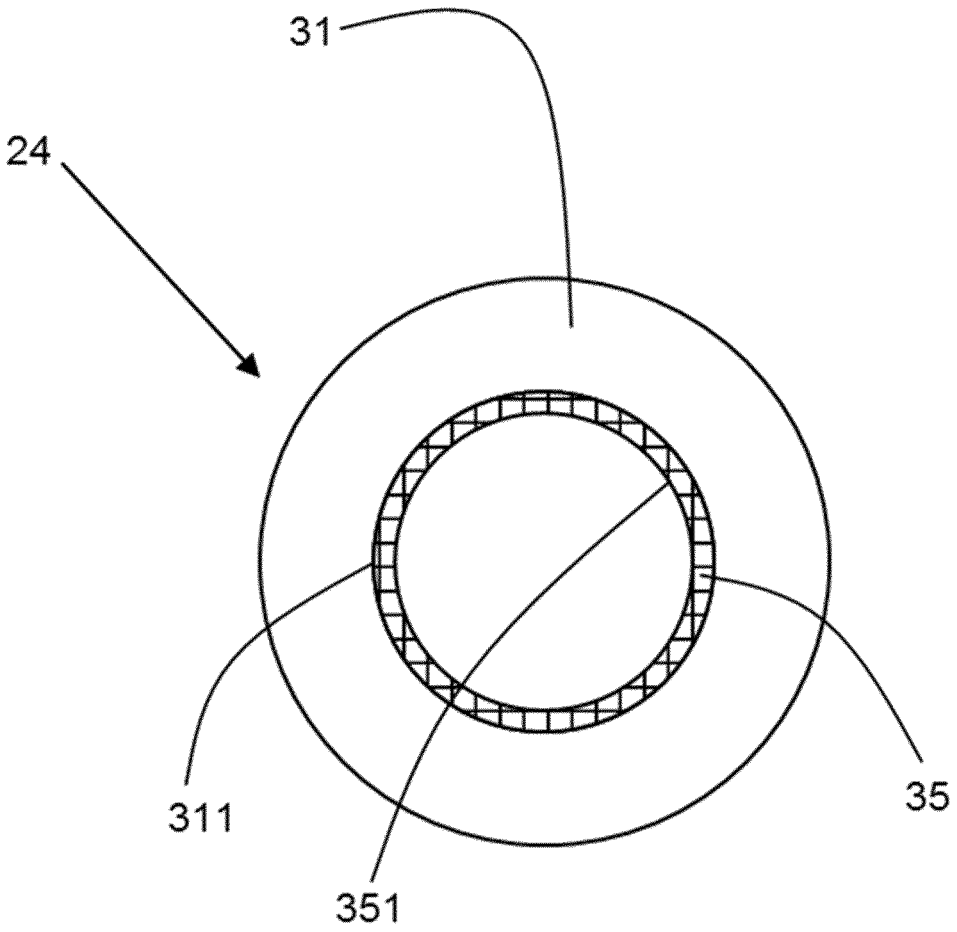
FIG. 3 shows a cross sectional view of the hollow tubular segment of FIG. 2 as taken perpendicular to the longitudinal axis of the aerosol-generating article.

As can be best seen from FIG. 3, in addition to comprising the hollow tube of crimped fibrous material 31, the hollow tubular segment 24 also comprises a plurality of non-crimped fibers 35. The plurality of non-crimped fibers 35 extend along and are affixed to the inner surface of the hollow tube 31. The plurality of non-crimped fibers 35 extend along the entire length of the hollow tube 31 and form a substantially continuous layer covering the inner surface of the hollow tube 31 of crimped fibrous material. This means that the inner surface of the hollow tubular segment 24 is formed by the inner surface 351 of the substantially continuous layer of non-crimped fibers 35. The thickness of the continuous layer of non-crimped fibers 35 relative to the thickness of the hollow tube 31 is not shown to scale in FIG. 3. The continuous layer of non-crimped fibers 35 may be secured to the hollow tube 31 by way of a binder, by way of an adhesive or by way of both a binder and an adhesive. The continuous layer of non-crimped fibers 35 may have a colour that is different to the colour of the hollow tube 31.

The invention claimed is:

1. An aerosol-generating article comprising:

an aerosol-generating substrate and a mouthpiece disposed downstream of the aerosol-generating substrate, the mouthpiece comprising:

a hollow tubular segment at its downstream end defining a mouth end cavity, the hollow tubular segment comprising:

a hollow tube of crimped fibrous material; and a plurality of non-crimped fibers extending along and affixed to the inner surface of the hollow tube, wherein (i) the hollow tube of crimped fibrous material and (ii) the plurality of non-crimped fibers extending along and affixed to the inner surface of the hollow tube together form the hollow tubular segment.

2. The aerosol-generating article according to claim 1, wherein each of the non-crimped fibers have a colour that is different from the colour of crimped fibers forming the hollow tube of crimped fibrous material.

3. The aerosol-generating article according to claim 1, wherein the non-crimped fibers have a denier per filament of at least 6.

4. The aerosol-generating article according to claim 1, wherein the non-crimped fibers have a total denier of from about 6,000 to about 20,000.

5. The aerosol-generating article according to claim 1, wherein the non-crimped fibers form a substantially continuous layer covering the inner surface of the hollow tube of crimped fibrous material.

6. The aerosol-generating article according to claim 5, wherein the substantially continuous layer covers the entire inner surface of the hollow tube of crimped fibrous material.

7. The aerosol-generating article according to claim 5, wherein the substantially continuous layer has a thickness of from about 300 microns to about 500 microns.

8. The aerosol-generating article according to claim 1, wherein the non-crimped fibers comprise an acetate ester of cellulose.

9. The aerosol-generating article according to claim 1, further comprising a binder disposed between the plurality of non-crimped fibers and the inner surface of the hollow tube.

10. The aerosol-generating article according to claim 9, wherein the binder comprises an ester of glycerol.

11. The aerosol-generating article according to claim 1, wherein about 600 to about 800 non-crimped fibers are affixed to the inner surface of the hollow tube.

12. The aerosol-generating article according to claim 1, wherein each of the plurality of non-crimped fibers extend substantially in the longitudinal direction of the aerosol-generating article.

13. A hollow tubular segment for a mouthpiece of an aerosol-generating article, the segment comprising:

a hollow tube of crimped fibrous material, and a plurality of non-crimped fibers extending along and affixed to the inner surface of the hollow tub, wherein (i) the hollow tube of crimped fibrous material and (ii) the plurality of non-crimped fibers extending along and affixed to the inner surface of the hollow tube together form the hollow tubular segment.

14. A method of forming a hollow tubular segment for a mouthpiece of an aerosol-generating article, the method comprising:

conveying a first continuous band of crimped fibers;

conveying a second continuous band of non-crimped fibers;

shaping a portion of the first continuous band into a substantially annular shape having an outer surface and an inner surface;

conveying the second continuous band into contact with the inner surface of the substantially annular shaped portion of the first continuous band; and affixing the contacted portions together and cutting a segment of the affixed portions from the continuous band to form a hollow tubular segment for a mouthpiece of an aerosol-generating article such that (i) the crimped fibers and (ii) the non-crimped fibers together form the hollow tubular segment.

15. The method according to claim 14, further comprising:

spraying a binder onto the annular shaped portion such that at least some binder resides on the inner surface of the annular shaped portion, prior to affixing the contacted portions together.

* * * * *